United States Patent [19]

Knürr

[11] Patent Number: 4,463,057

[45] Date of Patent: Jul. 31, 1984

[54] EXTRUDED SECTION BAR MEMBER

[76] Inventor: Hans Knürr, Am Strassland 14, D-8011 Kirchheim, Fed. Rep. of Germany

[21] Appl. No.: 409,828

[22] Filed: Aug. 20, 1982

[30] Foreign Application Priority Data

Aug. 24, 1981 [DE] Fed. Rep. of Germany ..... 3133457

[51] Int. Cl.[3] ..... B21C 37/00

[52] U.S. Cl. ..... 428/595; 428/599; 428/582; 428/575; 52/731; 52/720; 248/158; 248/188.1; 405/277; 72/253.1; 72/254; 191/22 DM

[58] Field of Search ..... 428/595, 599, 582, 573, 428/575; 52/731, 720; 248/158, 188.1; 405/277; 72/253.1, 254; 191/122 DM

[56] References Cited

U.S. PATENT DOCUMENTS

| | | | |
|---|---|---|---|
| 1,031,000 | 7/1912 | Higgin | 428/582 |
| 4,005,255 | 1/1977 | Wagner et al. | 428/614 |

FOREIGN PATENT DOCUMENTS

| | | | |
|---|---|---|---|
| 327567 | 8/1933 | Italy | 191/22 |
| 351261 | 11/1936 | Italy | 52/720 |

*Primary Examiner*—L. Dewayne Rutledge
*Assistant Examiner*—Debbie Yee
*Attorney, Agent, or Firm*—Fleit, Jacobson, Cohn & Price

[57] ABSTRACT

An extruded section bar member for use as a vertical support in furniture, particularly in industrial and office furniture, comprising a cross section corresponding to an elongated rectangle with rounded edges and including T-grooves recessed into its long sides for receiving fastening elements.

19 Claims, 1 Drawing Figure

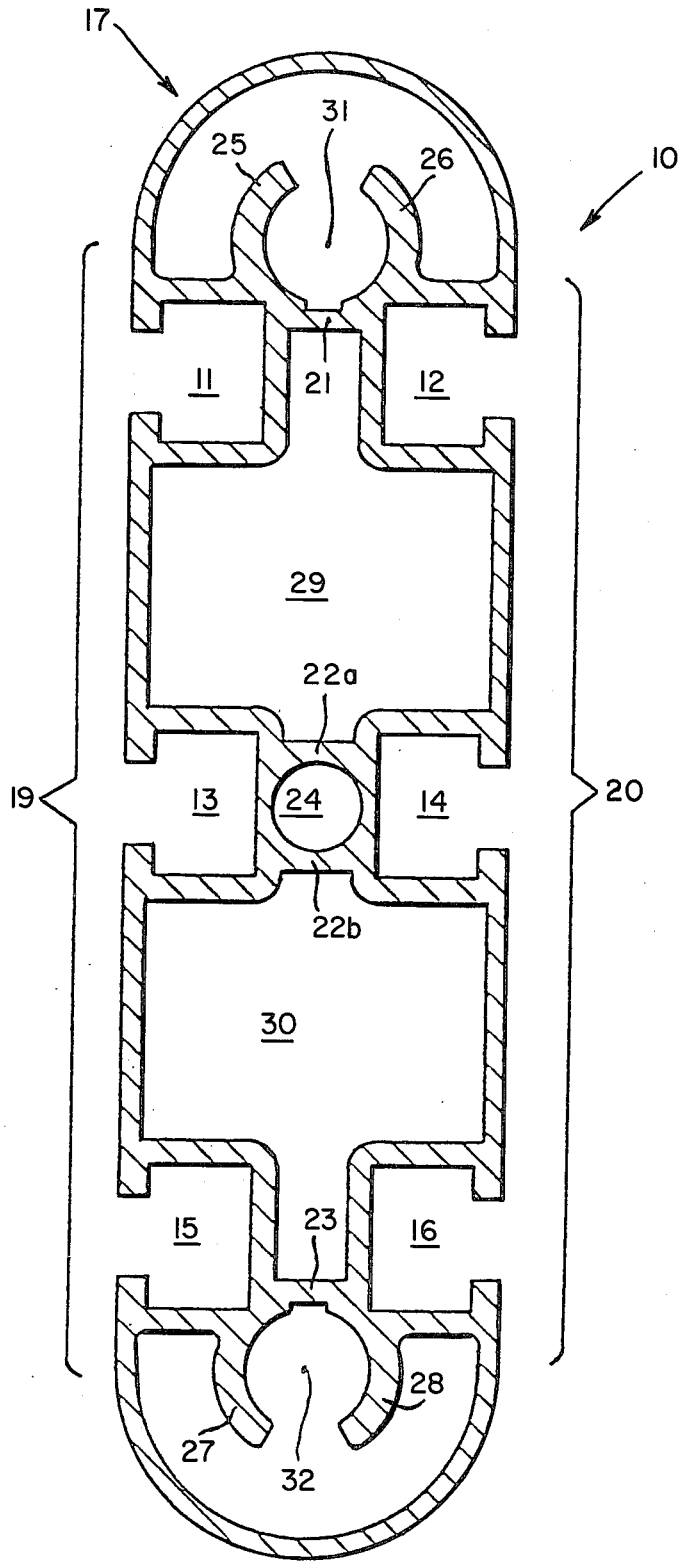
17
31
25
26
10
11
21
12
29
22a
19
13
24
14
20
22b
30
15
23
16
28
27
32

EXTRUDED SECTION BAR MEMBER

The invention relates to an extruded section bar element of metal for furniture and particularly for use as the vertical support for industrial and office furniture.

A variety of extruded section bar members of metal has been known which may be used, basically, for constructing furniture. However, all of these elements have but little utility for developing a universal furniture program which in use satisfies all practical requirements and at the same time is aesthetically pleasing in appearance.

Thus it is a principal object of the instant invention to provide an extruded section bar element of the type specified above which is universally adapted to creating a broad line of furniture, exhibits great strength, has an aesthetically pleasing appearance and offers a large variety of possibilities for attaching thereto furniture elements such as panel and wall members and shelving or boards.

This object is attained by providing a section bar element having in cross section an outline shape corresponding substantially to an elongated rectangle of which the end or short sides are rounded and which has T-shaped grooves recessed into the long sides and projecting into the section interior.

The inventive section bar element may be used for virtually all types of cabinets, racks, office, work, laboratory, conference and typewriter tables and many other types of furniture as a vertical support located preferrably in the corner areas of such furniture. With the aid of the T-shaped grooves, vertical wall members and panels as well as horizontal boards or shelves may readily be attached to these supports at any desired height in a very simple manner, yet with a strength and stability answering any practical need. As the T-shaped grooves extend along the entire height of the section member, attachment may be effected at any height desired.

In addition, the inventive section bar member offers the advantage of readjusting without difficulties the height of boards or shelves after these have been attached previously on a specific level.

The dimensions of the inventive section bar element are selected and proportioned to each other so that sufficient stability and strength will be obtained for any practical use; at the same time, a particularly pleasing aesthetic appearance will be obtained. In particular, the T-shaped grooves extending in parallel offer excellent possibilities of attachment; in addition, the relatively large side surfaces of the inventive section bar member are subdivided and structured in an aesthetically pleasing way. The T-shaped grooves prevent the formation of broad continuous surfaces; the discontinuity and structural effect results in a particularly pleasing optical impression without degrading the strength properties of the inventive section bar member. On the contrary: The inwardly projecting T-grooves act to stiffen the side walls, resulting in substantial bending and buckling strengths. The pleasing optical appearance as well as the purely practical utility are rendered advantageous by the continuous transition in cross section between the long sides and the rounded end or short sides. Advantageously, the rounded short sides may be semicircular in cross section. The rounded and preferrably semicircular short sides exhibit particular utility in practical applications because they reduce the danger of persons running into them sustaining injuries; in addition; they are particularly easy to clean.

Preferrably, the advantageous aesthetic effect produced by the T-shaped grooves may be enhanced by providing the surfaces of the inventive section bar element in a relatively dark color. This way the contrast between the surfaces on the one hand and the always relatively dark T-shaped grooves on the other will be attenuated; the surface pattern effect will be maintained, yet any harsh contrast will be avoided. Sufficient possibilities of attachment are ensured by providing at least two T-shaped grooves extending along each long side—particularly if these T-shaped grooves are arranged to extend in the end areas of the long sides adjacent the rounded short sides.

Preferrably, the possibilities for attaching additional furniture elements are improved further by providing another T-shaped groove centrally between any two T-shaped grooves located in the end areas of the long sides.

To obtain a weight as low as possible, the invention further contemplates to provide the section bar element in the form of a hollow section element having a wall thickness of about 10% to 20% of the longitudinal dimension of the rectangle defining the cross-sectional shape. In order to obtain a strength as high as possible, the T-shaped grooves may be arranged in pairs such that each T-shaped groove in one long side is directly opposite a T-shaped groove in the other long side, and at least one connecting web may be provided between the two T-shaped grooves of each pair.

Another advantageous development includes two spaced connecting webs at least between the two T-shaped grooves of a pair of T-shaped grooves arranged centrally in the long sides, with the mutually facing sides of such connecting webs being configured to define a circular opening. In this advantageous embodiment of the invention the circular opening may be used most conveniently for attaching a large variety of structural elements.

Further possibilities of attchment are created by the connecting web between the two T-shaped grooves located in the end area of the long sides having two clmap- or grip-like projections extending into the cavity defined by the rounded short sides, whereby the connecting web and the clamp- or grip-like projections define a horse shoe-shaped cross-sectional configuration. Preferrably, these clamp- or grip-like projections extend in parallel with the rounded short walls, and preferrably the clamp- or grip-like projections may be concentric with semicircular short walls, if provided.

The recesses as well as the openings result in substantial material savings when fabricating the inventive section bar elements; at the same time, they serve to facilitate the attachment of various structural elements.

To obtain a range of applications as broad as possible, the inventive section bar member will meet practical and aesthetic requirements particularly well if provided in dimensions of about 120 millimeters for the long side and of about 30 millimeters for the transverse side of the elongated rectangular cross-sectional shape. The configuration of the inventive section bar member results in sufficient strength even if the wall thickness of the hollow section bar member is reduced to about two millimeters or even to only about 1.8 millimeters.

For particularly high loads, the wall thickness of the peripheral portions in the area of the T-shaped grooves may be about 2.3 millimeters.

In a particularly advantageous embodiment of the inventive structure, free spaces are defined between adjacent pairs of T-shaped grooves, said spaces being rectangular in shape, substantially. This kind of free spaces may be utilized in a variety of ways—such as for cable runs or other types of conduit. As in office or laboratory premises as well as in industrial facilities it is frequent practice to run electric cables and the like from the floor to the table tops, the inventive section bar members having free spaces in the section cavity are particularly suited for accommodating cables and other conduit and for taking these to the area where the user needs access to their terminals.

In another advantageous embodiment of the inventive section bar member, a circular recess is defined interiorly of each horse shoe-shaped configuration between the clamp- or grip-like projections and the connecting web. Preferrably, such circulaar recess may include an opening between the free ends of the projections and facing the adjacent short side, with that open portion including a central angle of about 60 degrees. Apart from the convenience such configuration offers for fabrication by extrusion, it produces another free space for accommodating cables or the like or for affixing mechanical fastening elements. For the use of mechanical fastening elements introduced into the recesses. The resilience of the projections frequently is of advantage.

In the following, the invention will be shown and described in detail under reference to the appended drawing, in which the single FIGURE shows a cross-sectional view of the extruded section bar element of the instant invention.

As shown in the drawing, the extruded section bar element of the instant invention in its entirety has the reference numeral 10. Its cross section is in the shape of an elongated rectangle having three T-shaped grooves 11, 13, 15 and 12, 14, 16, respectively, in each one of its long sides 19 and 20, with the T-shaped grooves projecting into the section interior. The two long sides 19 and 20 merge continuously into rounded end or short sides 17 and 18. In the embodiment of the invention shown in the drawing, the two end or short sides 17 and 18 each comprise semicircular walls which merge tangentially into the long sides 19 and 20, respectively.

The T-shaped grooves are arranged in pairs so that the pairs of T-shaped grooves 11, 12 and 15, 16 are located in the two end areas of the long sides 19 and 20, respectively, and another pair of T-shaped grooves 13, 14 is provided centrally in long sides 19 and 20. Connecting webs 21, 22 and 23 are provided between the two T-shaped grooves of each pair of grooves. The connecting webs arranged between the opposite T-shaped grooves result in a substantial increase in the structural strength of the extruded section bar member of the invention.

The connecting web between T-shaped grooves 13, 14 in the central portion of the long sides 19, 20 is divided to define two web portions 22*a*, 22*b*. The mutually facing sides of the web portions are shaped to define between them a circular opening 24. This circular opening 24 may be used advantageously to receive mechanical fastening elements.

On both sides of connecting web 21 are provided clamp- or grip-like projections 25 and 26 so that connecting web 21 and the two projections 25, 26 define a horse shoe-shaped configuration. The space inside the horse shoe-shaped cavity is in the form of a circular recess 31. Between the two free ends of projections 25, 26 is provided an opening which includes a central angle of about 60 degrees. The aforementioned recess may be used, for example, to receive a mechanical fastening element, and in that case it may be of advantage that owing to their elasticity the two projections 25, 26 are capable of resilient outward bending. However, the circular recesss 31—as well as the free space defined between the two projections 25, 26 on the one hand and the end side 17 on the other—may be used equally to accommodate cables or the like.

Structure similar to that formed by connecting web 21, projections 25, 26 and circular recess 31 is provided on the opposite side of the section bar member by connecting web 23, projections 27, 28 and the circular recesss 32 defined therebetween.

Free spaces of a particularly large size are formed between adjacent pairs of T-shaped grooves and may be used for running electric cables or other types of utility lines. The two spaces 29, 30 are substantially rectangular in cross section, with an adjoining niche extending into the area between the two T-shaped grooves 11, 12 on the one hand and 15, 16 on the other.

Owing to its spatial configuration and structure, the cross-sectional shape shown in the drawing and described hereinabove is suited for an exceptionally large number of applications. In addition, it is an essential aspect of the invention that the cross-sectional configuration shown in the drawing and described above ensures a particularly high bending strength and a correspondingly high buckling strength.

I claim:

1. Extruded section bar member of metal for use as a vertical support in industrial and office furniture, characterized in that the bar member has in cross section a shape corresponding substantially to an elongated rectangle of which the short sides of said rectangle are rounded and which has at least two T-shaped grooves recessed into each of the long sides of said rectangle, projecting into the section interior, and extending along the entire height of the section member.

2. Extruded section bar member as in claim 1, characterized by a continuous transition from the long sides to the rounded end or short sides of the cross section of bar member.

3. Extruded section bar member as in claim 1, characterized in that rounded end or short sides are semicircular in cross section.

4. Extruded section bar member as in claim 1, characterized in that T-shaped grooves are provided in the end area of long sides adjoining said rounded end or short sides.

5. Extruded section bar member as in claim 1, characterized by another T-shaped groove provided centrally between the T-shaped grooves in the end area of each long side.

6. Extruded section bar member as in claim 1, characterized in that bar member comprises a hollow section bar member having a wall thickness of about 10% to 20% of the longitudinal dimension of the elongated cross-sectional rectangle.

7. Extruded section bar member as in claim 6, characterized in that T-shaped grooves are arranged in pairs such that each T-shaped groove in one long side is directly opposite a T-shaped groove in the other long side and that at least one connecting web is provided between the two T-shaped grooves of each pair of T-shaped grooves.

8. Extruded section bar member as in claim 7, characterized by two spaced connecting webs between at least the two T-shaped grooves of a pair of T-shaped grooves central in long sides, the mutually facing surfaces of said connecting webs being configured to create a circular opening.

9. Extruded section bar member as in claim 7, characterized in that connecting web between the two T-shaped grooves in the end area of long sides has two clamp- or grip-like projections extending into the space surrounded by the respective rounded end or short side, whereby each connecting web and said grip-like projections define a horse-shoe-shaped cross-sectional configuration.

10. Extruded section bar member as in claim 9, characterized in that said grip-like projections extend in parallel with the rounded end or short side walls.

11. Extruded section bar member as in claim 10, characterized in that in case said end or short side walls are semicircular said grip-like projections are concentric therewith.

12. Extruded section bar member as in claim 1, characterized in that the extruded section bar member has dimensions of about 120 millimeters for the long side and of about 30 millimeters for the transverse side of the elongated cross-sectional rectangle.

13. Extruded section bar member as in claim 6, characterized in that hollow section bar member has a wall thickness of about two millimeters.

14. Extruded section bar member as in claim 6, characterized in that hollow section bar member has a wall thickness of about 1.8 millimeter.

15. Extruded section bar member as in claim 6, characterized in that the wall thickness of the peripheral portions in the area of the T-shaped grooves is about 2.3 millimeters.

16. Extruded section bar member as in claim 6, characterized by free spaces formed between adjacent pairs of T-shaped grooves, said free spaces being substantially rectangular in shape.

17. Extruded section bar member as in claim 16, characterized in that free spaces each have dimensions of about 26 millimeters in the transverse direction and of about 20 millimeters in the longitudinal direction of the cross-sectional rectangle.

18. Extruded section bar member as in claim 6, characterized by a circular recess formed in the interior of said horse shoe-shaped configuration between grip-like projections and connecting webs.

19. Extruded section bar member as in claim 18, characterized in that circular recess has an open portion formed between the free ends of projections and facing said end or short sides, with said open portion including a central angle of about 60 degrees.

* * * * *